US007329192B2

(12) United States Patent
Gibree

(10) Patent No.: US 7,329,192 B2
(45) Date of Patent: Feb. 12, 2008

(54) INFANT SWING WITH VIBRATION

(75) Inventor: Steven Gibree, Slatersville, RI (US)

(73) Assignee: Summer Infant, Inc., Woonsocket, RI (US)

( * ) Notice: Subject to any disclaimer, the term of this patent is extended or adjusted under 35 U.S.C. 154(b) by 0 days.

(21) Appl. No.: 11/387,449

(22) Filed: Mar. 23, 2006

(65) Prior Publication Data

US 2006/0252566 A1 Nov. 9, 2006

Related U.S. Application Data

(60) Provisional application No. 60/667,803, filed on Mar. 30, 2005.

(51) Int. Cl.
*A63G 9/16* (2006.01)
*A63G 9/00* (2006.01)

(52) U.S. Cl. ..... 472/119; 5/105

(58) Field of Classification Search ..... 472/118–125; 297/273; 5/105–109
See application file for complete search history.

(56) References Cited

U.S. PATENT DOCUMENTS

| | | | | |
|---|---|---|---|---|
| 4,947,832 | A * | 8/1990 | Blitzer | 601/56 |
| 6,283,870 | B1 * | 9/2001 | Saint et al. | 472/119 |
| 6,431,646 | B1 * | 8/2002 | Longoria | 297/217.3 |
| 6,520,862 | B1 * | 2/2003 | Armbruster et al. | 472/118 |
| 6,544,128 | B1 * | 4/2003 | Yang | 472/119 |
| 6,561,915 | B2 * | 5/2003 | Kelly et al. | 472/119 |
| 2006/0052172 | A1 * | 3/2006 | Stephen et al. | 472/135 |

* cited by examiner

*Primary Examiner*—Kien T Nguyen
(74) *Attorney, Agent, or Firm*—IP Strategies

(57) ABSTRACT

A swing includes a mechanism for providing a vibrating motion to the infant suspended in the swing seat. The swing includes a swing support, a child-receiving seat, a swing arm, and a vibration mechanism. The swing arm is coupled to the seat and has a first end that is pivotally connected to the support. The vibration mechanism is disposed to impart a vibrating motion to the seat.

25 Claims, 3 Drawing Sheets

INFANT SWING WITH VIBRATION

CROSS-REFERENCE TO RELATED APPLICATION

This claims the benefit under 35 USC §119(e) of U.S. Provisional Patent Application Ser. No. 60/667,803, which was filed on Mar. 30, 2005.

FIELD OF THE INVENTION

The present invention relates to seats for infants and small children, in particular seats that impart a motion to the seated child, such as a swinging motion, a vibrating motion, or a bouncing motion.

BACKGROUND OF THE INVENTION

Children's swings are well-known. These swings include a support, usually in the form of a fabric sling-type seat or rigid seat, suspended in some manner from a frame support or doorway. A child sitting or reclining in the swing moves back and forth with the support. Some swings include a mechanism that provides the swinging motion, whereas other swings rely on gravity following an initial push from an adult. Infants and young children are soothed by the motion of the swing, which will often quiet a cranky child.

Swings that are powered by push and gravity only will keep an infant's attention only as long as a person continues to push the baby in the swing. Mechanical swings also usually wind down after a certain time, for practical reasons and as a safety measure. Once the swinging motion has stopped, the suspended infant could become irritable unless once again set in motion. This makes it difficult for a supervisory adult to keep a baby occupied and happy while momentarily attending to other matters.

BRIEF DESCRIPTION OF THE INVENTION

The present invention is a swing that includes a mechanism for providing a vibrating motion to the infant suspended in the swing seat. According to an aspect of the invention, the swing includes a swing support, a child-receiving seat, a swing arm, and a vibration mechanism. The swing arm is coupled to the seat and has a first end that is pivotally connected to the support. The vibration mechanism is disposed to impart a vibrating motion to the seat.

The seat can be removably coupled to the swing arm. It is contemplated, for example, that the seat can function as a seat, carrier, or bouncer apart from the rest of the swing.

The seat can include fabric. For example, the seat can be a sling-type fabric seat that provides support for the child. In this case, the vibration mechanism can be, for example, sewn into the fabric. The vibration mechanism can be disposed so as to touch the swing arm or a frame for the fabric, so as to impart vibration to the child through the swing arm or frame.

The seat can include a rigid frame. The vibration mechanism can be attached to the rigid frame, so as, for example, to impart vibration to the rigid frame. The seat can include a fabric cover fitted over the rigid frame. In this case, for example, the vibration mechanism can be disposed between the rigid frame and the fabric cover. Alternatively, the vibration mechanism can be sewn into the fabric cover. The rigid frame can include a number of components. In this case, the vibration mechanism can cause at least one of the components to move relative to at least one of the other components.

The seat can include a rigid support structure, and the vibration mechanism can be attached to the rigid support structure, such as to impart vibration to the rigid support structure. The seat can include a fabric cover disposed over the rigid support structure. In this case, the vibration mechanism can be disposed, for example, between the rigid support structure and the fabric cover. Alternatively, the vibration mechanism can be sewn into the fabric cover. The rigid support structure can include a number of components. In this case, the vibration mechanism can cause at least one of the components to move relative to at least one of the other components.

The swing can include a switch by which the vibration mechanism is manually actuated. The switch can be disposed, for example, on the vibration mechanism and/or on the support.

The swing can include a motion sensor that senses motion of the seat. The swing can also include a switch by which the vibration mechanism is automatically actuated when the motion sensor senses that the motion of the seat has stopped. Alternatively, or in addition, the swing can include a switch by which the vibration mechanism is automatically actuated when the motion sensor senses that the amplitude of the motion of the seat falls below a predetermined threshold.

The swing can include a timing circuit, preferably as an internal component of the vibration mechanism, that controls deactivation of the vibration mechanism. For example, the timing circuit can cause gradual decreasing of the vibration amplitude prior to deactivation.

Thus, the present invention is a swing that includes a mechanism for providing a vibrating motion to the infant seated in the swing. When the swing motion stops, or when manually activated, the vibrating sensation can continue to soothe the infant. This vibrating motion can be similar to that used in child bouncers. The vibrating motion can be provided by a mechanism included in or attached to the infant seat.

The present invention is not limited in scope to any particular type of infant swing. Multiple-speed mechanized swings can include the vibration feature of the present invention, as can swings that use a different type of infant support, such as swinging suspended cradles and other beds, and bench-style lawn swings.

DETAILED DESCRIPTION OF THE INVENTION

Figure 1:
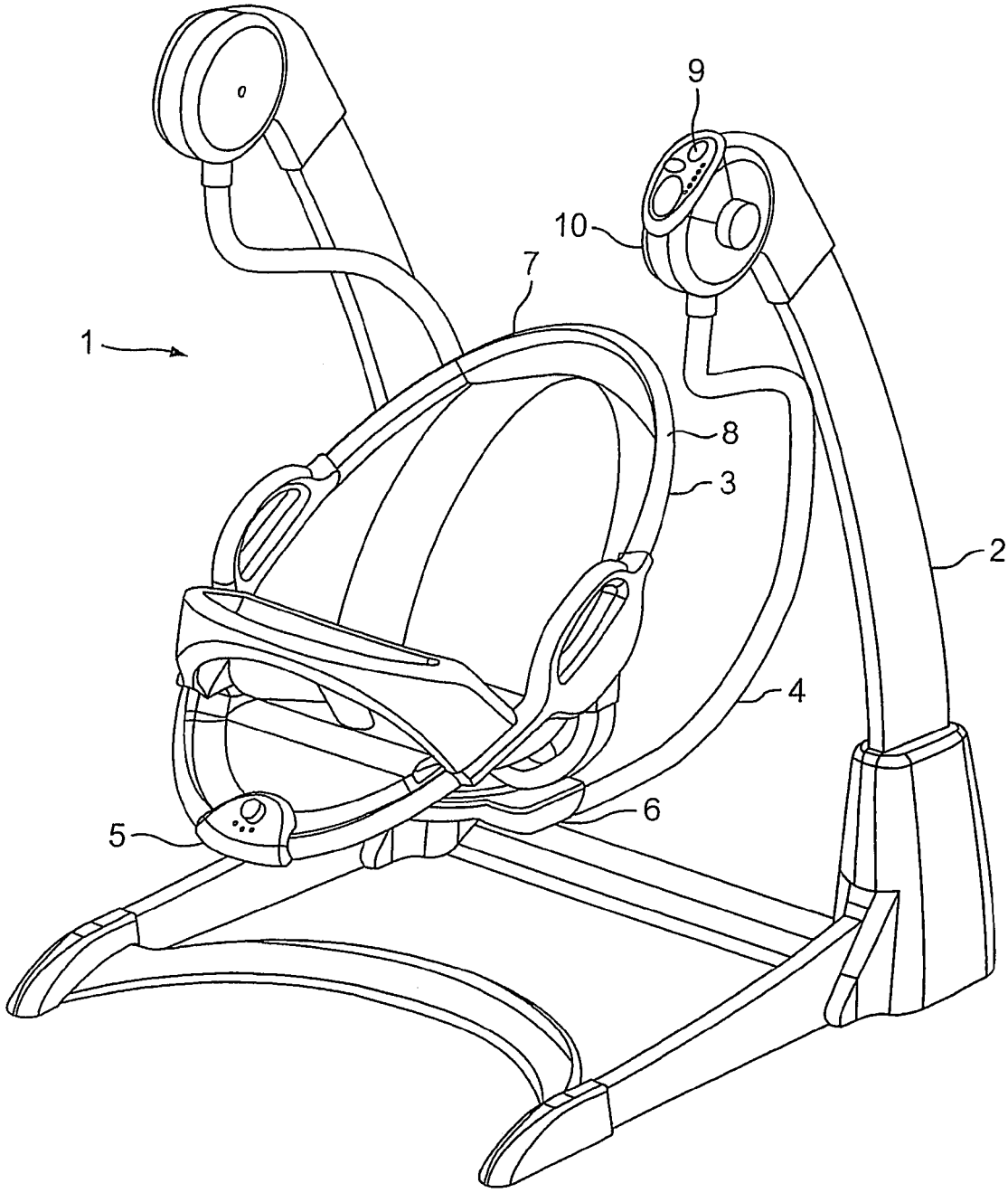
FIG. 1 is an illustration of an exemplary swing according to the invention.

As shown in FIG. 1, an exemplary embodiment of the swing 1 includes a swing support 2, a child-receiving seat 3, one or more swing arms 4, and a vibration mechanism 5. The swing arms 4 are coupled to the seat 3 and each have a first end that is pivotally connected to the support 2. The swing 1 can include more than two swing arms 4, and the swing arms 4 can be connected to the seat 3 at different positions than those shown. Two swing arms 4 will be shown and described for simplicity of explanation, and is not a limiting feature of the invention. The vibration mechanism 5 is shown coupled to the seat 3. In general, the vibration mechanism 5 can be disposed anywhere on the swing 1, coupled in communication with the seat 3 so as to impart a vibrating motion to the seat 3.

The seat 3 can be fixed to the swing arms 4, or can be removably coupled to the swing arms 4. For example, the seat 3 or the swing arms 4, or both, can include connectors 6 that allow the seat 3 to be firmly attached to the swing arms 4, and to be easily removed from the swing arms 4. It is contemplated that the removable seat 3 can also be reattached to the swing arms 4 in more than one position. Once removed, the seat 3 can function as a stationary child seat, a baby carrier, or even a bouncer if the vibration mechanism 5 remains coupled to the seat 3 on removal from the swing arms 4.

Figure 2:
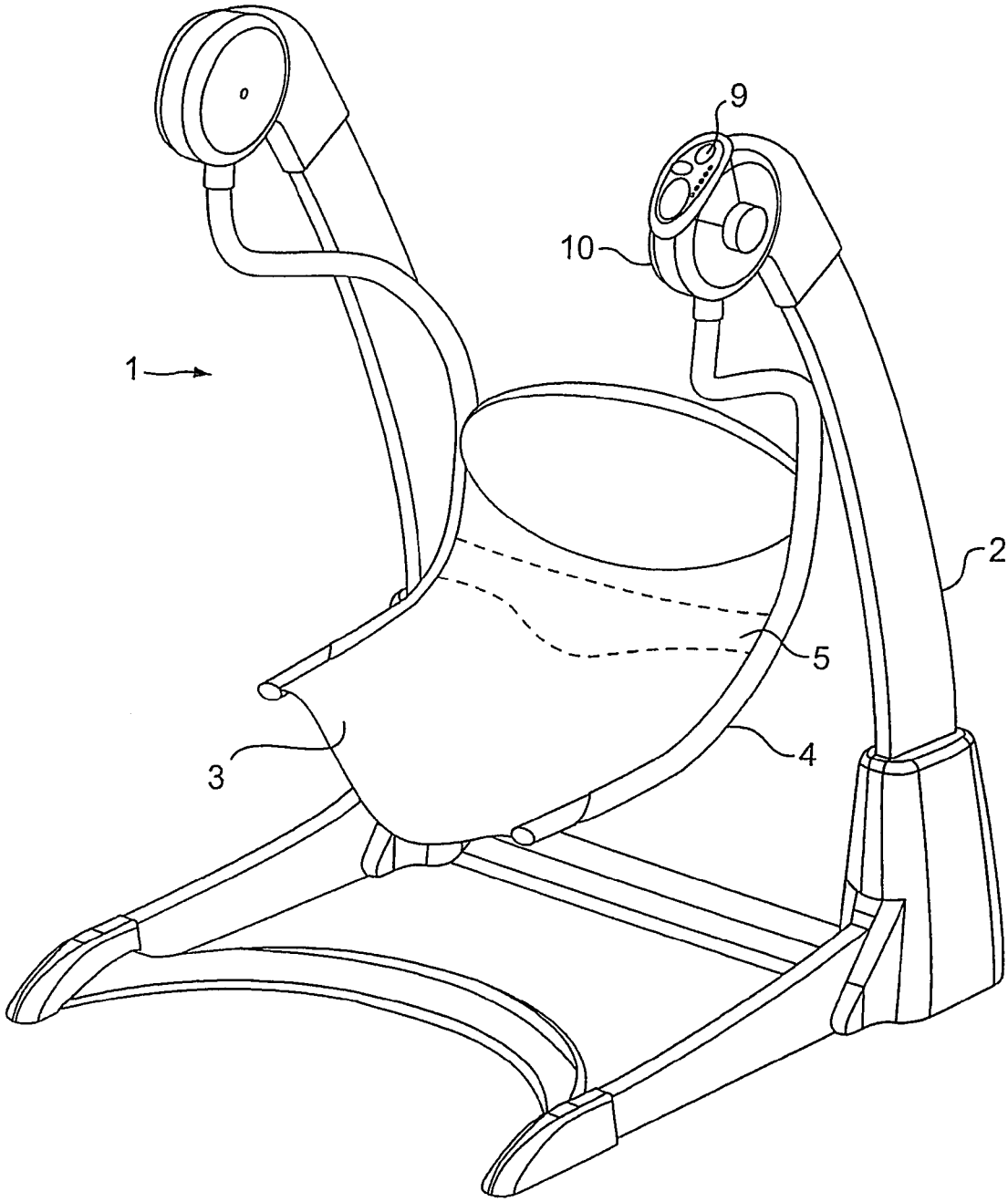
FIG. 2 is an illustration of another exemplary swing according to the invention, including a fabric seat.

According to the embodiment shown in FIG. 2, the seat 3 can be made of fabric, or primarily of fabric. For example, the seat 3 can be a sling-type fabric seat that provides support for the child. In this case, the vibration mechanism 5 can be, for example, sewn into the fabric of the seat 3. In this case, the vibration mechanism 5 can be touching at least one swing arm 4 or a frame for the fabric seat, or can otherwise be in mechanical communication with the swing arms 4 or frame. The vibration mechanism 5 can be disposed elsewhere on the swing 1, such as on the support 2, as long as the vibrating motion is imparted to the seat 3.

Figure 3:
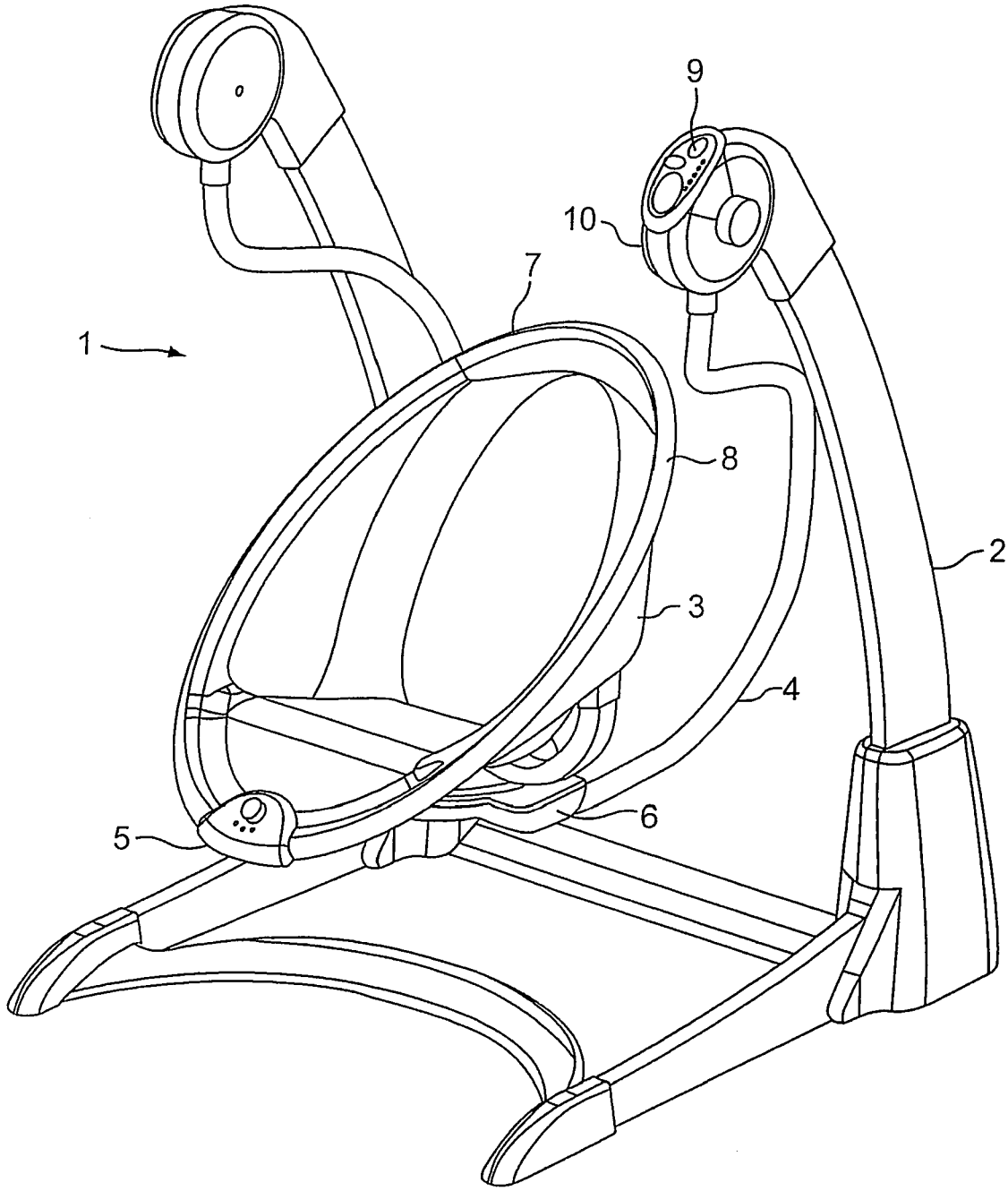
FIG. 3 is an illustration of another exemplary swing according to the invention, wherein the seat includes a fabric covered frame.

According to the embodiment shown in FIG. 3, the seat 3 can include a rigid frame 7, with a fabric cover 8 fitted over the frame 7. The vibration mechanism 5 can be attached to the rigid frame 7 as shown, so as to impart vibration to the rigid frame 7 and therefore indirectly to the child. The placement of the vibration mechanism 5 shown in the figure is exemplary only; any placement on the frame 7 that would provide a vibrating sensation to the child is contemplated. Alternatively, the vibration mechanism 5 can be disposed between the rigid frame 7 and the fabric cover 8, or can be sewn into the fabric cover 8, either to impart vibration directly to the child through the fabric, or to impart vibration to the rigid frame 7 and indirectly to the child. It is also contemplated that he rigid frame 7 can include a number of components that can move or flex relative to each other. In such embodiments, the vibration mechanism 5 can cause at least one of the components to move relative to at least one of the other components, thereby providing a vibrating or massaging motion to the child.

Alternatively, the seat 3 can include a rigid support structure, such as a hard shell forming the surface of the seat 3. The vibration mechanism 5 can be attached to the rigid support structure as shown, such as to impart vibration to the rigid support structure and therefore indirectly to the child. The seat 3 can include a fabric cover disposed over the rigid support structure, provided for the comfort of the child. In this case, the vibration mechanism 5 can be disposed, for example, between the rigid support structure and the fabric cover. Alternatively, the vibration mechanism 5 can be sewn into the fabric cover, either to impart vibration directly to the child through the fabric, or to impart vibration to the rigid support structure and indirectly to the child. It is also contemplated that the rigid support structure can include a number of components that can move or flex relative to each other. In such embodiments, the vibration mechanism 5 can cause at least one of the components to move relative to at least one of the other components, thereby providing a vibrating or massaging motion to the child.

As shown in FIGS. 1-3, the vibration mechanism 5 can be manually actuated by a switch included on the mechanism. Alternatively, or in addition, the switch 9 can be disposed on the support 2, for remote actuation of the mechanism 5, either in wired or wireless fashion. Placement of the switch 9 on the support 2 would make it easier for some adult supervisors to actuate and turn off the mechanism 5, particularly when the swing is in motion. Actuation by other than manual means as an alternative, or in addition, is also contemplated, as described below.

The swing 1 can include a motion sensor, in communication with the vibration mechanism 5 or as a part of the vibration mechanism 5, which senses motion of the seat 3, preferably the swinging motion of the seat 3. For example, the motion sensor 10 can be located at the connection of the swing arm 4 to the support 2, as shown in FIGS. 1-3, and can sense motion of the swing arm 4 and therefore of the seat 3. This embodiment also includes a switch by which the vibration mechanism 5 is automatically actuated when the motion sensor 10 senses that motion of the seat 3 has stopped. In particular embodiments, the motion sensor 10 provides the switch with information regarding the sensed amplitude of the swinging motion. The switch is automatically actuated when the sensed amplitude falls below a predetermined threshold, which preferably is adjustable. Thus, as the swinging motion of the seat 3 winds down, the vibrating motion is actuated.

The swing 1 can also include a timing circuit, preferably embodied as an internal component of the vibration mechanism 5, that controls deactivation of the vibration mechanism 5. The timing circuit can be used to provide any of several functions. For example, the timing circuit can control actuation and/or deactivation of the vibration mechanism 5, so as to provide an automatic vibration start time, an automatic vibration switch-off, or a timed cycling of the vibration motion. Alternatively, or in addition, the timing circuit can cause gradual decreasing of the vibration amplitude prior to deactivation.

Thus, the present invention is a swing that includes a mechanism for providing a vibrating motion to the infant seated in the swing. When the swing motion stops, the vibrating sensation can continue to soothe the infant, although the vibrating motion can be provided to the child at any time. This vibrating motion can be similar to that used in child bouncers, and the seat can be detached to be used independently as a carrier, seat, or bouncer. The vibrating motion can be provided by a mechanism included in or attached to the infant seat, or disposed otherwise on the swing.

The present invention is not limited in scope to any particular type of infant swing. Free-swing models, crank models, and single-speed and multiple-speed mechanized swings can include the vibration feature of the present invention, as can swings that use a different type of infant support, such as swinging suspended cradles and other beds, and bench-style lawn swings.

I claim:

1. A swing, comprising:

a swing support;

a child-receiving seat;

a swing arm that is coupled to the seat and having a first end that is pivotally connected to the support;

a vibration mechanism disposed to impart a vibrating motion to the seat;

a motion sensor that senses motion of the seat; and a switch by which the vibration mechanism is automatically actuated when the motion sensor senses that the amplitude of the motion of the seat is below a predetermined threshold.

2. The swing of claim 1, wherein the seat is removably coupled to the swing arm.

3. The swing of claim 1, wherein the seat includes fabric.

4. The swing of claim 3, wherein the vibration mechanism is sewn into the fabric.

5. The swing of claim 1, wherein the seat includes a rigid frame.

6. The swing of claim 5, wherein the vibration mechanism is attached to the rigid frame.

7. The swing of claim 5, wherein the vibration mechanism is disposed to impart vibration to the rigid frame.

8. The swing of claim 5, wherein the seat includes a fabric cover fitted over the rigid frame.

9. The swing of claim 8, wherein the vibration mechanism is disposed between the rigid frame and the fabric cover.

10. The swing of claim 8, wherein the vibration mechanism is sewn into the fabric cover.

11. The swing of claim 5, wherein the rigid frame includes a plurality of components.

12. The swing of claim 11, wherein the vibration mechanism causes at least one of the components to move relative to at least one other of the components.

13. The swing of claim 1, wherein the seat includes a rigid support structure.

14. The swing of claim 13, wherein the vibration mechanism is attached to the rigid support structure.

15. The swing of claim 13, wherein the vibration mechanism is disposed to impart vibration to the rigid support structure.

16. The swing of claim 13, wherein the seat includes a fabric cover disposed over the rigid support structure.

17. The swing of claim 16, wherein the vibration mechanism is disposed between the rigid support structure and the fabric cover.

18. The swing of claim 16, wherein the vibration mechanism is sewn into the fabric cover.

19. The swing of claim 13, wherein the rigid support structure includes a plurality of components.

20. The swing of claim 19, wherein the vibration mechanism causes at least one of the components to move relative to at least one other of the components.

21. The swing of claim 1, wherein the vibration mechanism includes a switch by which the vibration mechanism is manually actuated.

22. The swing of claim 21, wherein the switch is disposed on the support.

23. The swing of claim 1, wherein the switch is adapted to actuate the vibration mechanism automatically when the motion sensor senses that the motion of the seat has stopped.

24. The swing of claim 1, further comprising a timing circuit that controls deactivation of the vibration mechanism.

25. The swing of claim 24, wherein the timing circuit causes gradual decreasing of vibration amplitude prior to deactivation.

* * * * *